United States Patent [19]

Krupman et al.

[11] 4,177,070

[45] Dec. 4, 1979

[54] EXOTHERMIC SLAG-FORMING MIXTURE

[76] Inventors: Leonid I. Krupman, ulitsa R. Ljuxemburg 30a, kv. 17; Jury G. Yaroslavtsev, prosperkt Ilicha 10, kv. 15; Alexandr E. Sochnev, ulitsa Naberezhnaya 147, kv. 2, all of Donetsk; Jury P. Shamil, ulitsa 40 let Sovetskoi Ukrainy 13, kv. 2, Zaporozhie; Abram I. Khitrik, ulitsa pravdy 45a, kv. 10, Zaporozhie; Grigory I. Antipenko, ulitsa Lenina 153, kv. 8, Zaporozhie; Jury G. Smetanin, ulitsa Divnogorskaya 27, Zaporozhie; Albert N. Samsonov, prospekt Lenina 144, kv. 194, Zaporozhie; Vadim M. Ljudkovsky, ulitsa pobedy 99, kv. 51, Zaporozhie; Leonid M. Pokrass, ulitsa Pionerskaya 98, Donetsk; Anatoly A. Kurdjukov, bulvar Pushkina 25, kv. 13, Donetsk; Abram M. Ofengenden, ulitsa Tkachenko 135, kv. 20, Donetsk; Georgy G. Zhitnik, bulvar Pushkina 25, kv. 21, Donetsk, all of U.S.S.R.

[21] Appl. No.: 901,009

[22] Filed: Apr. 27, 1978

Related U.S. Application Data

[63] Continuation of Ser. No. 775,929, Mar. 9, 1976, abandoned.

[51] Int. Cl. ..... C22B 9/10

[52] U.S. Cl. ..... 75/257; 75/27; 75/57

[58] Field of Search ..... 75/27, 257, 57

[56] References Cited

U.S. PATENT DOCUMENTS

| | | | |
|---|---|---|---|
| 2,798,818 | 7/1957 | Pletsch | 75/27 |
| 2,799,575 | 7/1957 | Tisdule | 75/27 |
| 2,836,486 | 5/1958 | Brennan | 75/27 |
| 4,014,685 | 3/1977 | Jones | 75/57 |

*Primary Examiner*—P. D. Rosenberg
*Attorney, Agent, or Firm*—Haseltine, Lake & Waters

[57] ABSTRACT

The present invention resides essentially in that a proposed mixture comprises an aluminium powder, nitre and a silica-containing component, the mixture composition, according to the invention, incorporating, apart from said constituents, calcium oxide, expanded pearlite or fluorspar, and a silicon-containing component. The proposed mixture provides for the burning thereof with subsequent formation of molten slag therefrom adapted for refining steel in a ladle.

4 Claims, No Drawings

EXOTHERMIC SLAG-FORMING MIXTURE

This is a continuation of U.S. Pat. Application Ser. No. 775,929, filed Mar. 9, 1976, now abandoned.

The preset invention relates to the production of ferrous metals, and more particularly to exothermic slag-forming mixtures.

The present invention may prove to be moxt advantageous in the off-furnace refining of steels of responsible application, such as ball bearing, stainless steels, etc.

As is known, the acid open-hearth process preceded the basic one. A disadvantage of the acid open-hearth process lies in a low speed of oxidizing impurities, though high quality of the metal produced justified the process duration.

At the same time an ever growing demand for high-quality metal was an impetus to new searches for more efficient methods of the metal production. Melting steel in a basic open-hearth furnace or in a converter turned out to be the most efficient technique to ensure production of quality steel. To improve the quality of the produced steel it is treated by synthetic slags in a ladle.

It has been found that research and practical work at a number of works both in this country and abroad that the quality of steel treated by basic slags is not dependent on its melting technique (be it a basic open-hearth furnace or a converter), with the characteristics thereof being equal to, and in some instances superior to the steel produced in an electric furnace.

However, the refining of steel in a ladle by basic synthetic slags drastically diminishes its contamination with sulphide inclusions, offering therewith a small reduction in its oxygen contents and in the amount of the most dangerous oxide inclusions. It is sometimes the removal of oxygen and not sulphur that assumes a paramount importance along with the provision in the metal of nonmetallics of a favourable composition and configuration, as far instance in producing ball bearing and stainless steels.

It is therefore believed that a method of production of high-quality steel, wherein it is melted in a high-production unit (a basic open-hearth furnace, converter, etc.) with subsequent treatment by an acid synthetic slag in a ladle, is likely to find wide application in future.

Known in the art is a method of producing the synthetic slg in a separate unit, more often in an electric furnace. This method requires considerable expences. In most cases slag-melting units are impossible to be arranged in operating steel-melting shops and the combined operation of the slag- and steel-melting units is also a problem to tackle.

Known also is a method of producing the synthetic slag from an exothermic mixture, comprising 13–16 weight per cent of an aluminium powder, 12–16 weight per cent nitre, the balance being a silica-containing component.

The selection of an aluminium powder as a combustible is attributed to the fact that it liberates a maximum amount of heat per unit weight as compared with other substances. Besides, it is relatively inexpensive and always available.

As to nitre, incorporated into the composition of the proposed mixture, use may be made of either sodium or potassium nitrate. The selection of nitre as a source of oxygen is preferred because it is rich in oxygen and has a great heat effect, as opposed to other oxidizers (metal oxides, nitrites, etc.).

As regards the silica-containing component, use may be made of quartz sand, silicate lumps, etc., which are adaptable for introducing into the slag a requisite amount of silica, which is the basic refinery component.

In this case the composition of the prior-art mixture failed to provide its burning, thus rendering impossible the production of molten slag for refining steel in a ladle, namely: for reducing its oxygen content as well as the amount of nonmetallics of the oxide nature.

The main object of the present invention is the provision of an exothermic slag-forming mixture capable of forming during its combustion molten slag adaptable for refining steel in a ladle.

Said and other objects of the invention are achieved by the provision of an exothermic slag-forming mixture for refining steel, said mixture comprising an aluminium powder, nitre, a silica-containing component, and whose composition, according to the invention, apart from said constituents, incorporates calcium oxide, expanded pearlite or fluorspar and a silicon-containing component.

The proposed mixture composition ensures the production of the molten slag capable of refining steel by deoxidizing and removing nonmetallic inclusions of the oxide nature.

It has been found that a higher combustion rate of said mixture can be attained by increasing the content of combustibles therein. However, as shown by calculations, said increase in the mixture combustion rate, obtained through higher aluminium content, is inexpedient insofar as it adds considerably to the mixture cost.

It has been experimentally proved that the most efficient means of adjusting the mixture combustion rate within a broad range is the use of calcium oxide in the presence of small amounts of fluorides (expanded pearlite or fluorspar). The introduction of calcium oxide into the mixture composition enabled, as shown by an analysis of a phase $CaO—Al_2O_3—SiO_2$ diagram to reduce the melting point of the produced slag to 1300–1400° C., said temperature being indirectly associated with the mixture combustion rate.

It is most reasonable that the exothermic mixture to employed, comprising (weight per cent):

| | |
|---|---|
| aluminium powder | 0.1–15 |
| sodium nitrate | 24–40 |
| calcium oxide | 5–15 |
| silicon-containing component | 0.1–20 |
| fluorspar or expanded pearlite | 5–15 |
| silica-containing component | the balance. |

The amount of reducers (of the aluminium powder and silicon-containing component) and of an oxidizer (sodium nitrate) is selected to provide the amount of heat required for melting the mixture and heating the slag to a steel temperature ranging from 1550 to 1650°0 C., i.e. the mixture heat content must aount from 3000 to 3500 kJ per kg of the proposed mixture.

As to the amount of sodium nitrate, it is selected in a stoichiometric ratio with the reducer.

The size of particles of the combustible materials must not exceed 1.5 mm to avoid an abrupt slow-down of the mixture combustion rate and, hence, of the slag-forming process.

According to a particular embodiment of the exothermic mixture, it is expedient that a mixture be used, comprising 0.1 to 6 weight per cent of powdered silicon as a silicon-containing component, the weight percentage of the other constituents being as follows:

| | |
|---|---|
| aluminium powder | 9–15 |
| sodium nitrate | 28–30 |
| calcium oxide | 5–15 |
| fluorspar or expanded pearlite | 5–15 |
| silica-containing component | the balance. |

The heat content of the proposed mixture ranging within 300–3500 kJ/kg corresponds to an aluminium powder content of 15% or to the aluminium powder taken in combination with 0.1 - 6% of the silicon-containing material. It has been found that the replacement of aluminium by silicon taken in an amount over 6% is impractical because it results in a substantial decrease in the mixture combustion rate, and the mixture comprising 8% silicon, is non-burning whatever.

Partial replacement of the aluminium powder by pulverized silicon is dictated by the fact that it increases the content of a major refinery component- silica in the slag being produced, and decreases an alumina content adversely affecting the properties of the slag.

According to another embodiment of said exothermic slag-forming mixture, it is expedient that the mixture be employed, comprising from 5 to 20% of calcium-silicon in combination with 0.1–20% of manganese ore used as the silicon-containing component, the weight percentage of the other constituents being as follows:

| | |
|---|---|
| aluminium powder | 0.1–10 |
| sodium nitrate | 24–40 |
| calcium oxide | 5–15 |
| fluorspar of expanded pearlite | 5–15 |
| silica-contaning component | the balance. |

The use of 5–20% of calcium-silicon as the combustible component is dependent on the fact that during the burning of the proposed mixture it precludes the formation of alumina that preconditions the creation in steel of coarse inclusions of the corundum type, which, on a number of occasions, deteriorates the quality of metal.

The amount of the manganese ore in the mixture affects, as shown by experiments, both the composition and nature of oxide inclusions. With the amount of the manganese ore in the exothermic mixture equal to 0.1%, said inclusions are represented by brittle oxidic inclusions, while with the content of the manganese ore in said exothermic mixture rising to 20%, these inclusions consists of plastic oxidic inclusions. This is important in selecting the slag composition for refining particular steel grades.

The exothermic slag-forming mixture of the proposed composition features considerable advantages as compared to the prior-art exothermic mixture of the same type, this being proved experimentally.

EXAMPLE 1 For treating medium carbon steel melted in a basic open-hearth furnace and comprising 0.0151% oxygen in a 140 t ladle, use is made of 4.5 t of a mixture (mixture consumption amounting to 3% of the steel weight) of the following composition (weight per cent):

| | |
|---|---|
| aluminium powder | 15 |
| powdered silicon | 0.1 |
| sodium nitrate | 28 |

-continued

| | |
|---|---|
| calcium oxide | 10 |
| fluorspar | 5 |
| quartz sand | the balance. |

When burning said mixture a molten slag is formed, said slag being heated to a temperature of 1600° C. contains: 46% silica, 17% calcium oxide, 26% alumina, 5% sodium oxide, 5% fluorides, the sum of impurities being the balance.

After treatment the steel comprised 0.0055% oxygen, i.e. the deoxidizing degree amounted to 65%.

The metal was also noted for improved mechanical properties, impact toughness in particular.

EXAMPLE 2

For refining in a ladle of ball bearing steel, comprising about 1% carbon and 1.5% chromium and melted in a 0.5 t induction furnace, use was made of an exothermic mixture (mixture consumption amounting to 6% of the metal weight).Said exothermic mixture had the following composition (weight per cent):

| | |
|---|---|
| aluminium powder | 9 |
| powdered silicon | 6 |
| sodium nitrate | 30 |
| calcium oxide | 15 |
| expanded pearlite | 15 |
| silicate lumps | the balance. |

Upon burning said mixture, the slag comprised 50% silica, 16% calcium oxide, 18% alumina, 10% sodium oxide, the sum of impurities being the balance.

Final oxygen contents in said ball bearing steel treated with the slag in the ladle was 0.0042%.

EXAMPLE 3

Ball bearing steel, comprising about 1% carbon and 1.5% chromium was melted in a 0.5 t induction furnace and treated in a ladle by slag produced from an exothermic mixture (mixture consumption was 6% of the metal weight) of the following composition (weight per cent):

| | |
|---|---|
| aluminium powder | 12 |
| powder silicon | 3 |
| sodium nitrate | 29 |
| calcium oxide | 10 |
| fluorspar | 7 |
| quartz sand | the balance. |

The composition of the produced slag was as follows: 48% silica, 14% calcium oxide, 24% alumina, 6% fluorides, 8% sodium oxides.

After treatment the steel contained 0.0045% oxygen. As to globular inclusions they were characterized by as low point as 0.5, oxide inclusions ranging from 2.5 to 3.0 points

EXAMPLE 4

Ball bearing steel, comprising about 1% carbon and 1.5% chromium was melted in a 0.5 t induction furnace and treated in a ladle by a slag produced from an exothermic mixture (mixture consumption was 6% of the metal weight) of the following composition (weight per cent):

| | |
|---|---|
| aluminium powder | 0.1 |
| calcium-silicon | 20 |
| sodium nitrate | 40 |
| calcium oxide | 15 |
| fluorspar | 5 |
| magnaese ore | 0.1 |
| silicate lumps | the balance. |

The produced slag had the following composition (weight per cent): 60% silica, 20% calcium oxide, 1.5% alumina, 12% sodium oxide, 2% fluorides, the sum of impurities being the balance.

Globular inclusions were characterized by as low points as 0.5–1.0 points, while oxide inclusions varied from 1.5 to 2.0 points.

EXAMPLE 5

Ball bearing steel, comprising about 1% carbon and 1.5% chromium, melted in a 0.5 t induction furnace, was treated in a ladle by slag produced from an exothermic mixture (mixture consumption amounted to 6% of the metal weight) of the following composition (weight per cent):

| | |
|---|---|
| aluminium powder | 10 |
| calcium-silicon | 5 |
| sodium nitrate | 28 |
| calcium oxide | 5 |
| manganese ore | 20 |
| expanded pearliet | 15 |
| quartz sand | the balance. |

The produced slag had the following composition (weight per cent): 45% silica, 18% alumina, 8% sodium oxide, 15% manganese oxides, 10% calcium oxides, the sum of impurities—the balance. Globular inclusions were characterized by as low point as 0.5–1.0, whereas oxide inclusions varied from 1.5 to 2.5 points.

EXAMPLE 6

Ball bearing steel, comprising about 1% carbon and 1.5% chromium was melted in a 60 t electric furnace. It was subjected to refining by a slag produced from a mixture (mixture consumption was 5% of the metal weight) of the following composition (weight per cent):

| | |
|---|---|
| aluminium powder | 5 |
| calcium-silicon | 11 |
| sodium nitrate | 28 |
| calcium oxide | 10 |
| fluorspar | 7 |
| manganese ore | 15 |
| quartz sand | the balance. |

The composition of the produced slag was as follows (weight per cent): 39% silica, 10% alumina, 27% calcium oxide, 10% manganese oxides, 10% sodium oxides, 5% fluorides.

After treatment the steel contained 0.0050% of oxygen, its oxide and globular inclusions 20 mm in diameter in profile being characterized by a low point ranging within 0.5–1.0.

What is claimed is:

1. An exothermic slag-forming mixture for refining metals, said mixture comprising an aluminium powder, sodium or potassium nitrate, a silica-containing component, calcium oxide, a compoent selected from the group consisting of expanded pearlite and fluorspar, and a silicon-containing component, said silicon being in elemental form.

2. An exothermic mixture as claimed in claim 1, comprising (weight per cent):

| | |
|---|---|
| aluminium powder | 0.1–15 |
| sodium nitrate | 24–40 |
| calcium oxide | 5–15 |
| silicon-containing component | 0.1–20 |
| component selected from the group consisting of expanded pearlite and fluorspar | 5–15 |
| silica-containing component | the balance. |

3. An exothermic mixture as claimed in claim 1, comprising from 0.1 to 6.0% of powdered silicon taken as a silicon-containing component, the weight percentage of its other constituents being as follows:

| | |
|---|---|
| aluminium powder | 9–15 |
| sodium nitrate | 28–30 |
| calcium oxide | 5–15 |
| component selected from the group consisting of expanded pearlite and fluorspar | 5–15 |
| silica-containing component | the balance. |

4. An exothermic mixture as claimed in claim 1, whose composition incorporates from 5 to 20.0% of calcium silicon in combination with 0.1–20% of manganese ore as a silicon-containing component, the weight percentage of the other mixture constituents being as follows:

| | |
|---|---|
| aluminium powder | 0.1–10 |
| sodium nitrate | 24–40 |
| calcium oxide | 5–45 |
| component selected from the group consisting of expanded pearlite and fluorspar | 5–15 |
| silica-containing component | the balance. |

* * * * *